US005131599A

United States Patent [19]

Maier

[11] Patent Number: 5,131,599

[45] Date of Patent: Jul. 21, 1992

[54] FUEL INJECTION VALVE

[75] Inventor: Stefan Maier, Bietigheim-Buch, Fed. Rep. of Germany

[73] Assignee: Robert Bosch GmbH, Stuttgart, Fed. Rep. of Germany

[21] Appl. No.: 671,891

[22] PCT Filed: Aug. 16, 1990

[86] PCT No.: PCT/DE90/00629

§ 371 Date: May 28, 1991

§ 102(e) Date: May 28, 1991

[87] PCT Pub. No.: WO91/04407

PCT Pub. Date: Apr. 4, 1991

[30] Foreign Application Priority Data

Sep. 22, 1989 [DE] Fed. Rep. of Germany ..... 3931604

[51] Int. Cl.[5] ..... F02M 51/06

[52] U.S. Cl. ..... 239/585.4; 239/900

[58] Field of Search ..... 239/585, 533.3-533.12; 251/129.18

[56] References Cited

U.S. PATENT DOCUMENTS 4,232,830 11/1980 Casey et al. ..... 239/585
4,360,161 11/1982 Claxton et al. ..... 239/585
4,887,769 12/1989 Okamoto et al. ..... 239/585

FOREIGN PATENT DOCUMENTS 104450 5/1942 Sweden .
105805 8/1942 Sweden .

*Primary Examiner*—Andres Kashnikow
*Assistant Examiner*—Kevin P. Weldon
*Attorney, Agent, or Firm*—Edwin E. Greigg; Ronald E. Greigg

[57] ABSTRACT

A fuel injection valve for internal combustion engines having a valve needle which works in conjunction with a valve seat to open and close a valve opening, this valve needle being activated by an electromagnet against a return spring. The return spring rests on a shoulder of an armature, which is fixedly connected with the valve needle, and on a setting tube which is guided in an axially movable opening in the interior of the magnet core of the electromagnet, and through which fuel travels from a fuel inlet nozzle to the valve opening. The valve needle stroke is limited by a cross link with a central stop point which is fixed in the interior of the magnet core. The setting tube is slit longitudinally in the end section facing the return spring and straddles the cross link here on both sides with clearance. Due to the cental stroke stop of the valve needle on the cross link, the valve needle stroke is always constant, even when the valve needle is not aligned with the valve housing axis.

20 Claims, 2 Drawing Sheets

Fig. 2
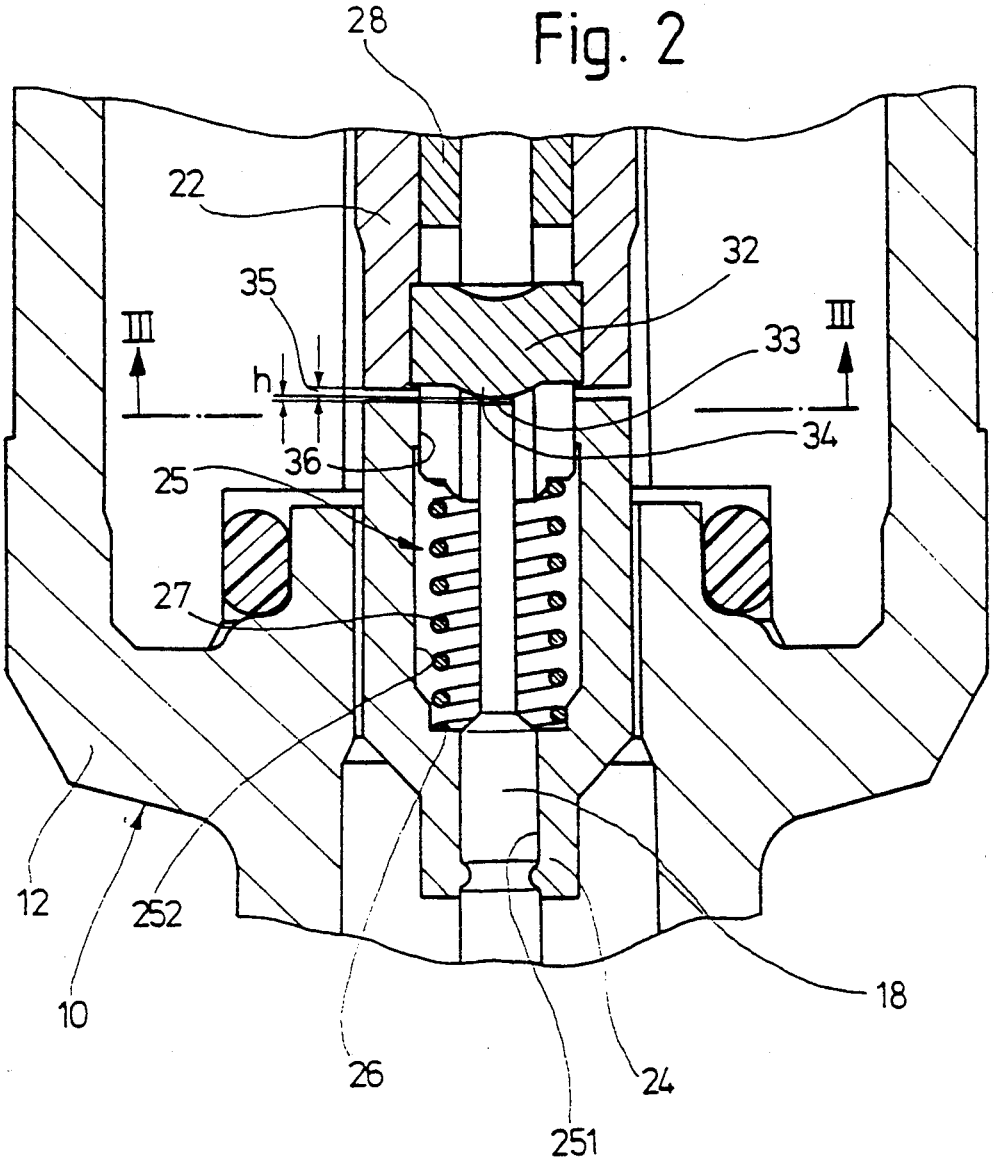
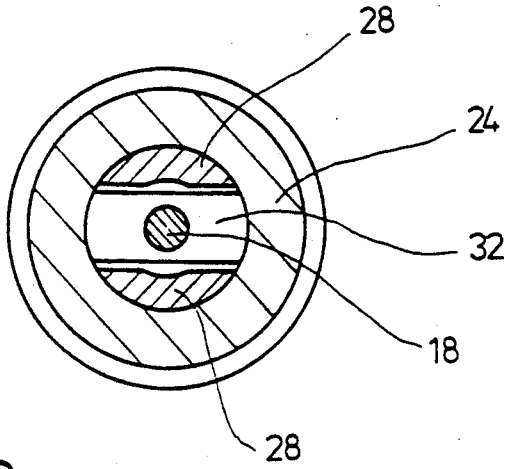
Fig. 3

FUEL INJECTION VALVE

BACKGROUND OF THE INVENTION

The invention is based on a fuel injection valve for internal combustion engines as set forth hereinafter.

In the case of a well-known fuel injection valve of this type (DE-OS 35 40 660 A1), the valve needle has a ring-shaped shoulder stop in the area between a valve needle guide in the valve space and the clamping of the valve needle in the armature; this shoulder stop works in conjunction with a stop ring, which represents the stroke stop, in the valve chamber, the bore of which is less than the external diameter of the shoulder stop and which covers the valve space. The stop ring is positioned in the valve chamber in such a way that when the shoulder stop rests on the stop ring between the front faces of the magnet core and the armature, which face one another, a residual air gap remains. The needle valve return spring, formed as a cylindrical compression spring, is housed in the hollow cylindrical interior of the magnet core, and rests in a cavity at the front end of the armature. By screwing the setting tube into or out from the magnet core, the pretensioning of the return spring can be altered independently of the valve needle stroke, and thus the dynamic through-flow of the fuel injection valve can be set.

The ring-shaped stroke stop for the valve needle has the disadvantage that where the valve needle is not in precise alignment, the arresting face of the ring shoulder on the stop ring changes from ring-shaped to sickle-shaped; thus the valve needle stroke does not conform to the stroke set, and as a result the amount of fuel injected varies. In order to largely avoid this, the valve needle has two large-diameter guide sections, placed at a relatively large distance from one another, which slide along the interior wall of the valve space. In order to enable the axial through-flow of fuel, these guide sections are flattened on the side. These construction measures necessitate not only increased expenditure in manufacture, but also require a minimum length of the valve needle section to be in the valve space, so that it is not possible to go below a certain axial construction length of the fuel injection valve.

ADVANTAGES OF THE INVENTION

The fuel injection valve which is the subject of this invention has the advantage that whilst retaining the setting facility for the needle valve return spring, a central stroke stop with a central stop point is realized; this stroke stop lies in the axis of the valve chamber. The arresting face of the valve needle is thus always dot-shaped, even when the valve needle is not exactly aligned, so that no alteration of the stroke arises during the opening of the valve needle. The amount of fuel injected is thus largely constant. Since the valve needle stroke is largely unaffected regarding any deviation of the valve needle axis from the valve chamber axis, the valve needle does not require additional guides in the valve space, but can make do with the guidance provided by the armature and the centering in the valve seat. The manufacturing costs of the fuel injection valve is thus considerably reduced. By means of the measures listed herein, advantageous developments and improvements of the fuel injection valve mentioned are possible.

If, in accordance with a preferred design form of the invention, the valve needle fixed in the armature is led through the armature by the end section which faces away from valve opening, so that on the opening stroke the valve needle stops with its front end directly on the cross link, then the situation achieved will be that the low retentivity components are not subjected to any mechanical stresses by the stroke stop. Thus separate surface treatment of these components can be dispensed with. The valve needle however, must be hardened so that it can withstand the mechanical stresses of the stop.

A further simplification of manufacture of the fuel injection valve which is the subject of this invention is achieved by the armature having a concentric blind hole which is open towards the magnet core, the return spring which surrounds the valve end section rests on the base of this hole, with the end of the slit setting tube projecting into the blind hole, and by virtue of the fact that the armature is guided axially slideable on the setting tube with a guide section, of annular shape, near the open end of the blind hole. By means of these measures, guidance of the armature is achieved in a simple manner, without need of an additional guide ring in the magnet housing.

SKETCH

The invention is explained in more detail in the description below, on the basis of a design example shown in the drawing. The figures show the following:

FIG. 2 shows ,an enlarged view of a central portion of FIG. 1; and

FIG. 3 shows a section along line III—III in FIG. 2.

DESCRIPTION OF THE DESIGN EXAMPLE

Figure 1:
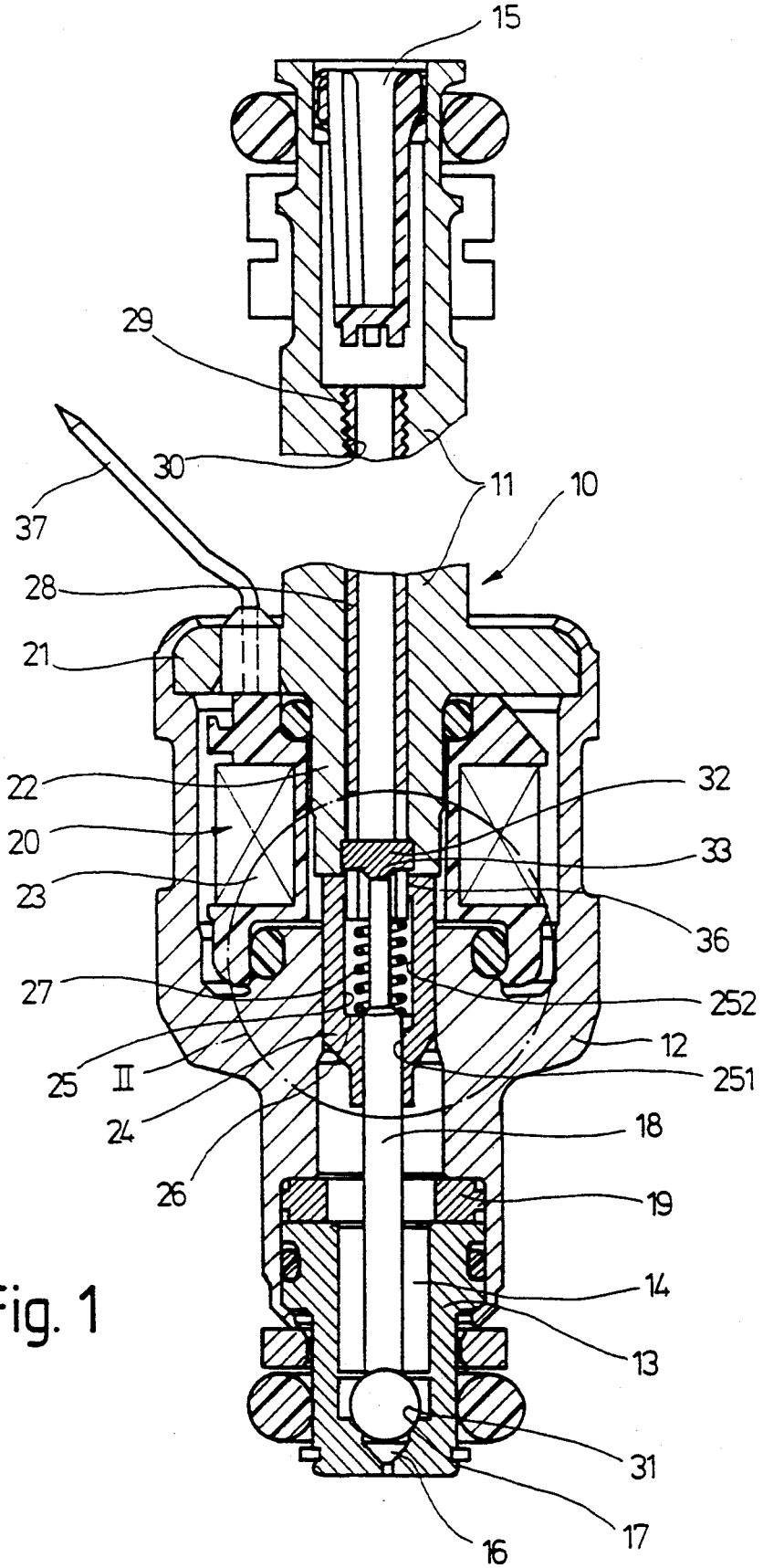
FIG. 1 shows a longitudinal section of a fuel injection valve for a fuel injection system of an internal combustion engine.

The fuel injection valve shown in longitudinal section in FIG. 1, for a fuel injection device of an internal combustion engine, shows a three-part housing 10 with an upper part 11, a middle part 12 and a lower part 13. The hollow cylindrical lower part 13, which contains a valve space 14, and upper part 11, which has an axial fuel inlet nozzle 15, are set into the middle part 12, which has a pot-shaped design, and are held by crimping. Valve space 14 is limited close to the lower end of lower part 13, by a valve opening 16, which in turn is surrounded by a valve seat 17. In order to release and close the valve opening 16, a valve needle 18 works together with valve seat 17; this valve needle is activated by an electromagnet 20. An intermediate ring is placed between the front of lower part 13 and the middle part 12 which opens out, in a nozzle-like manner, on the pot base. With a flange 21, upper part 11 covers middle part 12, and with a hollow cylindrical, nozzle-like co-axial projection 22, projects into the interior of middle part 12. On the outside of middle part 12 the projection 22 continues, in one piece, into a pipe section which forms fuel inlet nozzle 15.

The electromagnet 20, in a known manner, consists of a magnet of ferromagnetic material, a co-axial magnet core, which here is formed by projection 22 of the upper part 11, also manufactured from ferromagnetic material, a magnet coil 23 surrounding magnet core 22, and an armature 24 which is held in the base area of the middle part 12 and whose front face lies opposite magnet core 22. The electrical feed line to magnet coil 23 is marked 37.

The armature 24 shows a concentric stepped hole 25. The smaller diameter hole section 251 firmly surrounds valve needle 18, which with a smaller diameter end section projects through to the larger diameter hole section 252. A return spring 27 in the form of a compression spring rests on the shoulder 26 which is formed at the transition of the hole sections 251, 252; with its other end, this return spring lies on the ring-shaped front face of a setting tube 28, axially movable, in the interior of the hollow cylindrical upper part 11. By means of the axial adjustment of setting tube 28 in upper part 11, which can, for example, be effected by screwing an external thread section 29 on setting tube 36 into an internal thread section 30 in upper part 11, the initial tension of return spring 27 can be set.

In order to limit the opening stroke of valve needle 18, which rests with a spherical sealing face 31, on valve seat 17 and which can be lifted off by excitation of magnet coil 23, a stroke stop in the form of a cross link 32 is fixed in the interior of the hollow cylindrical magnet core 22. For this, setting tube 28 is slit in the end area facing the return spring 27, and with this slit end section, it straddles the cross link 32 on both sides with clearance, as can be seen more clearly in FIG. 3. The cross link 32 has a centrally arranged stop point 33, i.e. one that lies in the valve housing axis; this stop point is formed by an arch 34 on the front face of cross link 32 facing the valve needle 18. On the valve needle stroke, the front end of valve needle 18 stops against this stop point 33. The arrangement and design of armature 24, cross link 32 and valve needle 18 are such that when the front end of valve needle 18 lies on stop point 33 on cross link 32, between the front faces of armature 24 and magnet core 22 which face one another, there remains a residual air gap 35, as can be seen in the enlarged diagram in FIG. 2. The maximum stroke of valve needle 18 is characterized by path h in FIG. 2. The cross link 32 and the setting tube 28 are manufactured from non-magnetic materials.

By means of the central stop point 33 of cross link 32, the stop face of the valve needle on cross link 32 is always dot-shaped, even when valve needle 18 is not exactly aligned with the axis of valve housing 10. Thus even in the case of a not exactly aligned valve needle 18, the valve needle stroke remains constant. Thus with each opening of the fuel injection valve, exactly the same amount of fuel is injected.

At the end, the hollow cylindrical armature 24 has a ring-shaped guide section 36 which projects radially inwards; this guide section is of one piece with the armature 24. With this guide section 36, the armature slides almost without clearance on the setting tube 28, which means that the armature 24 is guided precisely, even outside the base area of the magnet housing or middle part 12. Additional guiding media for valve needle 18 can thus be dispensed with.

The foregoing relates to preferred exemplary embodiments of the invention, it being understood that other variants and embodiments thereof are possible within the spirit and scope of the invention, the latter being defined by the appended claims.

I claim:

1. A fuel injection valve for fuel injection devices for internal combustion engines comprising a valve housing, an axial fuel inlet nozzle and a valve space connected with the latter, this valve space being limited by a valve opening which is surrounded by a valve seat, a valve needle which works together with the valve seat to open and close the valve opening, an electromagnet which activates the valve needle, this electromagnet housing a magnet housing with a co-axial, hollow cylindrical magnet core, a magnet coil surrounding the magnet core and an armature which is axially movable in the magnet housing said armature includes a front face lying opposite the magnet core, this armature being fixedly connected with a valve needle, a return spring for the valve needle which rests on one side of the armature and on the other side of the front end of an axially movable setting tube in the magnet core, a stroke stop to limit the opening stroke of the valve needle, the stroke stop is arranged in a fixed position as a cross link (32) with a central stop point (33) in the interior of the hollow cylindrical magnet core (22), and that the setting tube (28) is slit longitudinally in the end section facing the return spring (27) and overlaps the cross link (32) on both sides with a clearance.

2. A fuel injection valve in accordance with claim 1, in which the armature (24) shows a co-axial blind hole (252) which is open to the magnet core (22), the return spring (27) surrounds the valve needle end section and rests on a base of this blind hole; the end of the setting tube (28) projects into the blind hole (252) and the armature (24) is guided, in an axially controlled manner, by a ring-shaped guide section (36) on the setting tube (28) formed close to the open end of the blind hole (252).

3. A fuel injection valve in accordance with claim 2, in which the cross link (32) and the setting tube (28) are manufactured from non-magnetic material.

4. A fuel injection valve in accordance with claim 2, in which the magnet housing of the electromagnet (20) is formed by a position of the valve housing (12).

5. A fuel injection valve in accordance with claim 1, in which the cross link (32) and the setting tube (28) are manufactured from non-magnetic material.

6. A fuel injection valve in accordance with claim 5, in which the magnet housing of the electromagnet (20) is formed by a position of the valve housing (12).

7. A fuel injection valve in accordance with claim 1 in which the magnet housing of the electromagnet (20) is formed by a portion of the valve housing (12).

8. A fuel injection valve in accordance with claim 1, in which the valve needle (18) is fixed in the armature including an end section which faces away from the valve opening (16), extends through the armature (24), and a front end stops directly against the cross link (32).

9. A fuel injection valve in accordance with claim 8, in which the arrangement and design of armature (24) cross link (32) and the valve needle end facing said crosslinks are such that when the valve needle (18) lies on the stop point (33) of the cross link (32) between the front faces of the armature (24) and the magnet core (22) which face one another, there remains a residual air gap (35).

10. A fuel injection valve in accordance with claim 8, in which the central stop point (33) of the cross link (32) is formed by an arch (34) on the cross link (32) which faces the valve needle (18).

11. A fuel injection valve in accordance with claim 9, in which the armature (24) shows a co-axial blind hole (252) which is open to the magnet core (22), the return spring (27) surrounds the valve needle end section and rests on a base of this blind hole; the end of the setting tube (28) projects into the blind hole (252) and the armature (24) is guided, in an axially controlled manner, by a ring-shaped guide section (36) on the setting tube (28) formed close to the open end of the blind hole (252).

12. A fuel injection valve in accordance with claim 9, in which the cross link (32) and the setting tube (28) are manufactured from non-magnetic material.

13. A fuel injection valve in accordance with claim 9, in which the magnet housing of the electromagnet (20) is formed by a portion of the valve housing (12).

14. A fuel injection valve in accordance with claim 8, in which the central stop point (33) of the cross link (32) is formed by an arch (34) on of the cross link (32) which faces the valve needle (18).

15. A fuel injection valve in accordance with claim 14, in which the armature (24) shows a co-axial blind hole (252) which is open to the magnet core (22), the return spring (27) surrounds the valve needle end section and rests on a base of this blind hole; the end of the setting tube (28) projects into the blind hole (252) and the armature (24) is guided, in an axially controlled manner, by a ring-shaped guide section (36) on the setting tube (28) formed close to the open end of the blind hole (252).

16. A fuel injection valve in accordance with claim 14. in which the cross link (32) and the setting tube (28) are manufactured from non-magnetic material.

17. A fuel injection valve in accordance with claim 14, in which the magnet housing of the electromagnet (20) is formed by a portion of the valve housing (12).

18. A fuel injection valve in accordance with claim 8, in which the armature (24) shows a co-axial blind hole (252) which is open to the magnet core (22), the return spring (27) surrounds the valve needle end section and rests on a base of this blind hole; the end of the setting tube (28) projects into the blind hole (252) and the armature (24) is guided, in an axially controlled manner, by a ring-shaped guide section (36) on the setting tube (28) formed close to the open end of the blind hole (252).

19. A fuel injection valve in accordance with claim 8, in which the cross link (32) and the setting tube (28) are manufactured from non-magnetic material.

20. A fuel injection valve in accordance with claim 8, in which the magnet housing of the electromagnet (20) is formed by a portion of the valve housing (12).

* * * * *